US005373950A

United States Patent [19]

Marc

[11] Patent Number: 5,373,950

[45] Date of Patent: Dec. 20, 1994

[54] TOWEL RACK APPARATUS

[76] Inventor: Jacques S. Marc, 245 S. Serrano Ave., Los Angeles, Calif. 90004

[21] Appl. No.: 123,051

[22] Filed: Sep. 20, 1993

[51] Int. Cl.[5] ..... A47F 5/00

[52] U.S. Cl. ..... 211/87; 211/105.1; 211/123

[58] Field of Search ..... 211/87, 105.1, 123, 211/103, 94.5; D6/546, 548, 549

[56] References Cited

U.S. PATENT DOCUMENTS

| | | | |
|---|---|---|---|
| D. 190,552 | 6/1961 | Doucet | 211/123 X |
| D. 303,470 | 9/1989 | Razumov | D6/546 |
| 1,303,812 | 5/1919 | Anderson | 211/123 X |
| 3,260,021 | 7/1966 | Katz | 211/105.1 X |
| 4,718,562 | 1/1988 | Winkler | 211/94.5 |
| 4,991,724 | 2/1991 | Wei | 211/105.1 X |

OTHER PUBLICATIONS

Maleck Catalogue, p. 30, 1980.

*Primary Examiner*—Robert W. Gibson, Jr.
*Attorney, Agent, or Firm*—E. Michael Combs

[57] ABSTRACT

A towel rack is arranged to permit positioning of hand towel structure in a spaced relationship relative to a bath towel permitting the positioning of first and second mounting bars to secure the various towel portions in a spaced relationship permitting their spacing maintaining freshness of the structure. The invention is further arranged to include selective mounting of support bracket structure underlying the first mounting bar for positioning of accessory hand towels thereon and providing for spacing of the support bracket structure relative to the first mounting bar for the adjustable positioning of accessory towels thereon.

2 Claims, 4 Drawing Sheets

FIG. 7
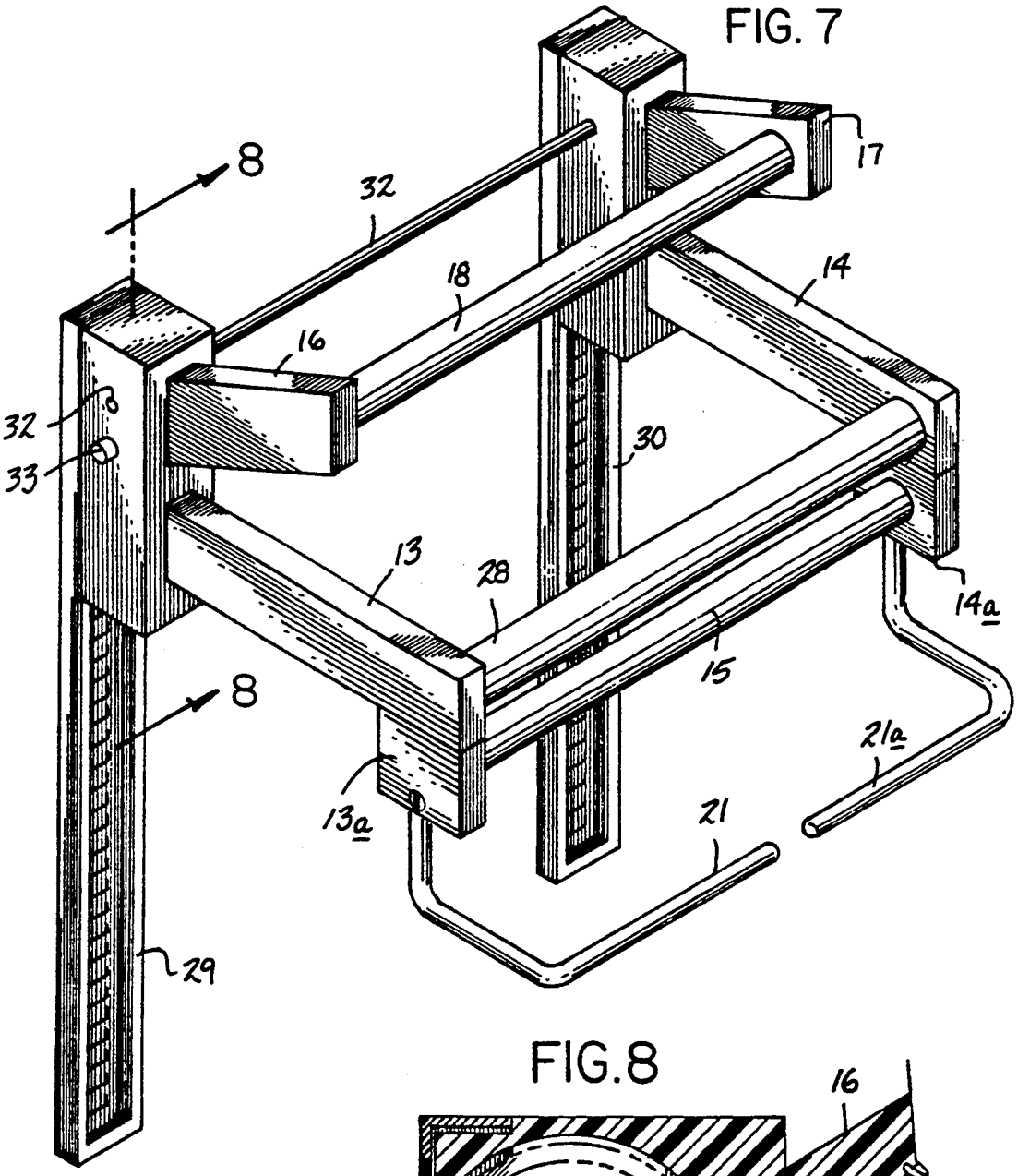
FIG.8
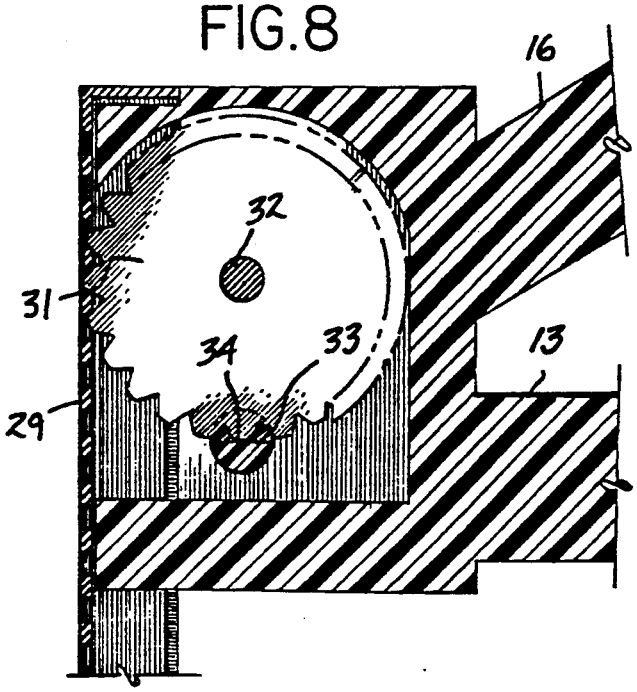
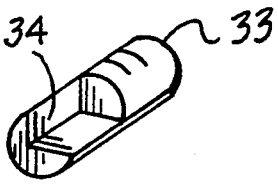
FIG. 8A

TOWEL RACK APPARATUS

BACKGROUND OF THE INVENTION

1. Field of the Invention

The field of invention relates to towel rack apparatus, and more particularly pertains to a new and improved towel rack apparatus wherein the same is arranged to provide for multiple support of towel members in a spaced relationship.

2. Description of the Prior Art

To overcome deficiencies of the prior art in permitting the positioning of a plurality of towel members in a spaced relationship relative to one another, the instance invention includes portable mounting bar structure relative to the towel rack organization to provide for the spacing of towel members in a spaced relationship to permit their drying and aeration and in this respect, the present invention substantially fulfills this need.

SUMMARY OF THE INVENTION

In view of the foregoing disadvantages inherent in the known types of towel rack apparatus now present in the prior art, the present invention provides a towel rack apparatus wherein the same is arranged to include a plurality of mounting bars in a spaced parallel relationship relative to one another to support a plurality of hand towels thereon. As such, the general purpose of the present invention, which will be described subsequently in greater detail, is to provide a new and improved towel rack apparatus which has all the advantages of the prior art towel rack apparatus and none of the disadvantages.

To attain this, the present invention provides a towel rack arranged to permit positioning of hand towel structure in a spaced relationship relative to a bath towel permitting the positioning of first and second mounting bars to secure the various towel portions in a spaced relationship permitting their spacing maintaining freshness of the structure. The invention is further arranged to include selective mounting of support bracket structure underlying the first mounting bar for positioning of accessory hand towels thereon and providing for spacing of the support bracket structure relative to the first mounting bar for the adjustable positioning of accessory towels thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures , methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved towel rack apparatus which has all the advantages of the prior art towel rack apparatus and none of the disadvantages.

It is another object of the present invention to provide a new and improved towel rack apparatus which may be easily and efficiently manufactured and marketed.

It is a further object of the present invention to provide a new and improved towel rack apparatus which is of a durable and reliable construction.

An even further object of the present invention is to provide a new and improved towel rack apparatus which is susceptible of a low cost of manufacture with regard to both materials and labor, and which accordingly is then susceptible of low prices of sale to the consuming public, thereby making such towel rack apparatus economically available to the buying public.

Still yet another object of the present invention is to provide a new and improved towel rack apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the invention arranged for mounting to a gear rack: structure permitting vertical adjustment of the mounting bar structure.

FIG. 8 is an orthographic view, taken along the lines 8—8 of FIG. 7 in the direction indicated by the arrows.

FIG. 8*a* is an isometric view indicating the locking shaft and the V-shaped notch for receiving a periphery of the gear member, as indicated in FIG. 8.

DESCRIPTION OF THE PREFERRED EMBODIMENT

Figure 1:
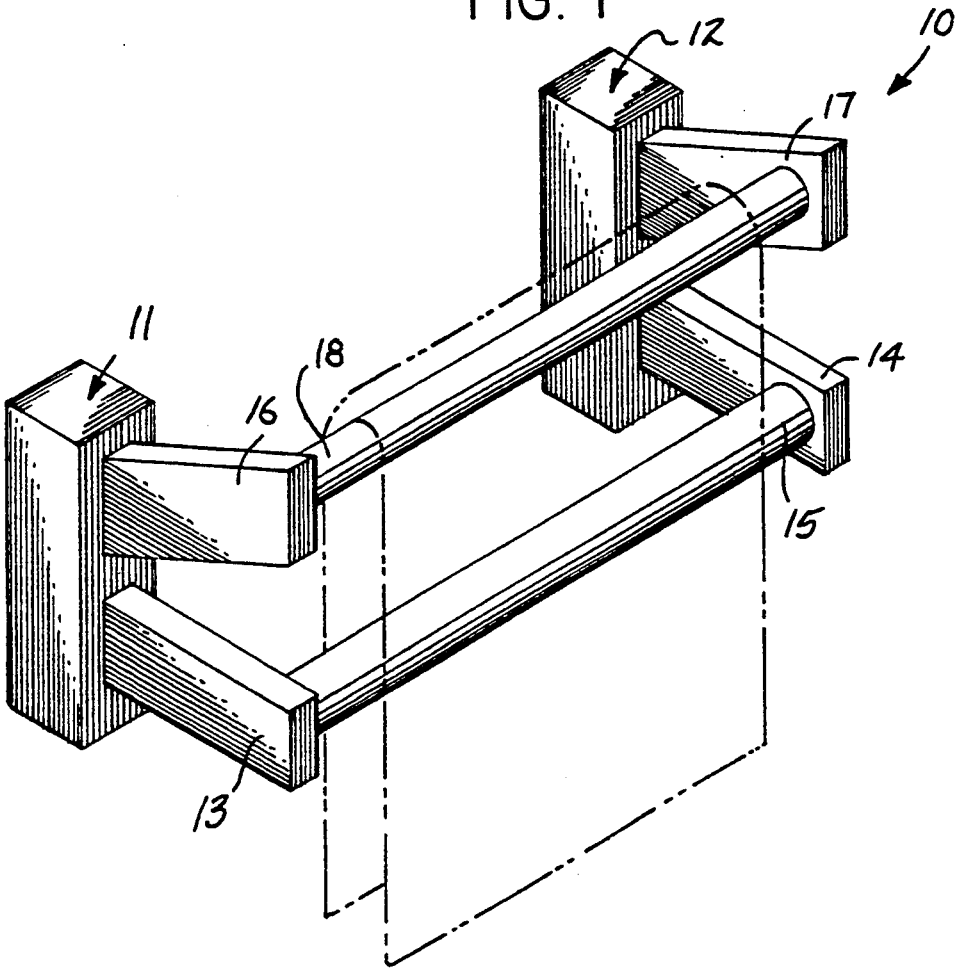
FIG. 1 is an isometric illustration of the invention.
Figure 2:
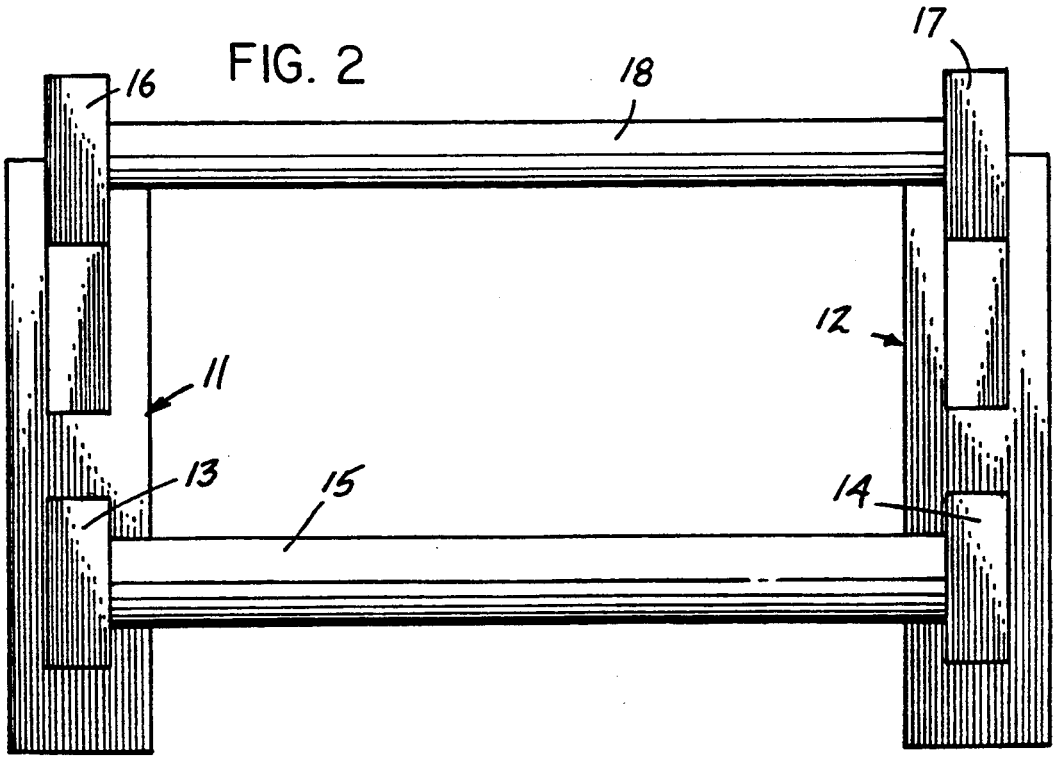
FIG. 2 is an orthographic frontal view of the invention taken in elevation.

With reference now to the drawings, and in particular to FIGS. 1 to 8*a* thereof, a new and improved towel rack apparatus embodying the principles and concepts of the present invention and generally designated by the reference numeral 10 will be described.

More specifically, the towel rack apparatus 10 of the instant invention essentially comprises a first support post 11 spaced from, parallel to, and in a coextensive relationship relative to a second support post 12. A first leg 13 is orthogonally mounted to the first support post 11, with a second leg 14 orthogonally mounted to the second support post 12, with the first and second legs 13 and It in a parallel coextensive relationship. A first mounting bar 15 extends orthogonally between the first and second legs 13 and 14. Respective third and fourth legs 16 and 17 are canted upwardly relative to the respective first and second legs 13 and 14, with the third and fourth legs mounting a second mounting bar 18 therebetween, with the second mounting bar 18 arranged in a parallel spaced relationship relative to the first mounting bar 15 permitting the first and second mounting bars to support separate towel members thereon in a spaced relationship.

Figure 3:
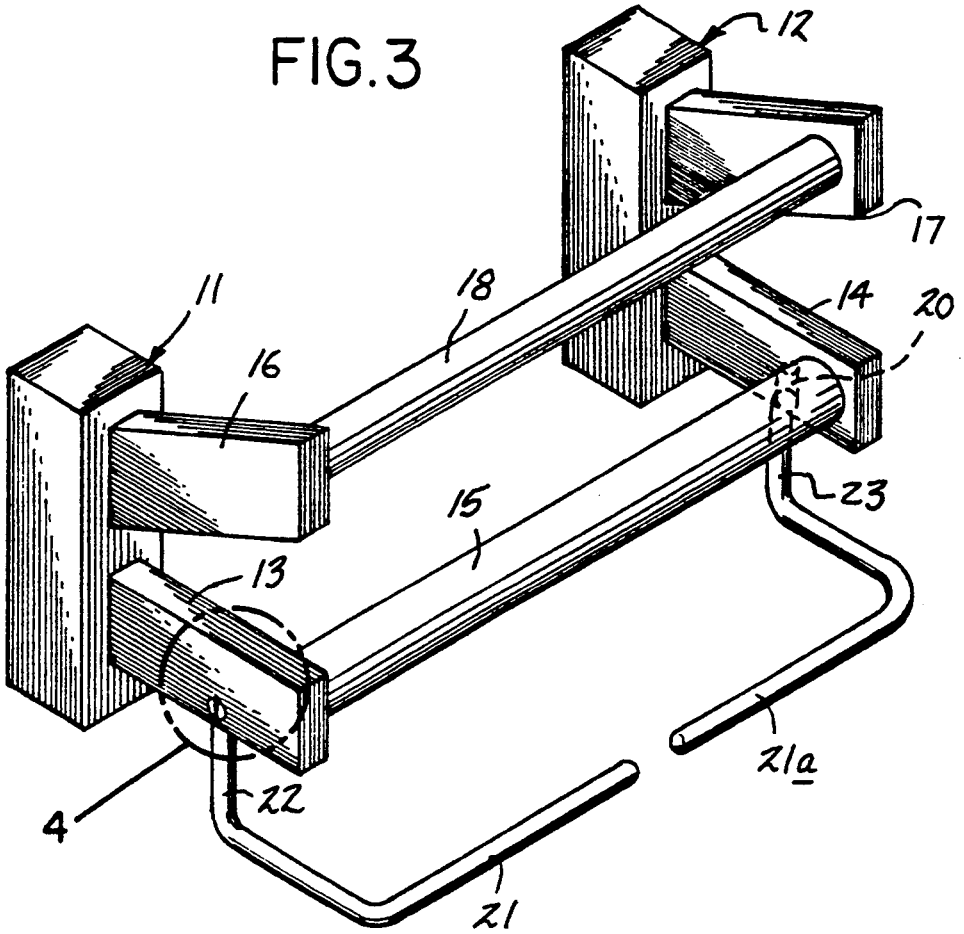
FIG. 3 is an isometric illustration of a modified aspect of the invention.
Figure 4:
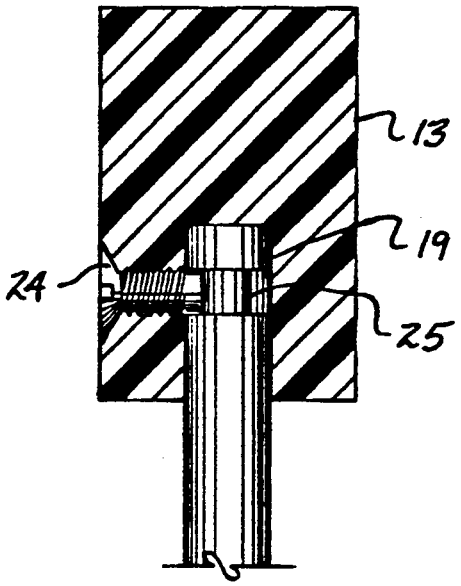
FIG. 4 is an enlarged cross-sectional view of section as set forth in FIG. 3.

Additionally, and with reference to the FIGS. 3 and 4 for example, first and second leg bores 19 and 20 directed into the respective first and second legs 13 and 14 receive respective first and second rod legs 22 and 23 of respective first and second rods 21 and 21*a* respectively. The respective first and second rods 21 and 21*a* permit additional separate hand towels in a spaced relationship, with each of the first and second legs 13 and 14 having a fastener 24 orthogonally intersecting a respective first and second rod leg, with the first and second rod legs each having an annular recess 25 to receive a respective fastener 24. In this manner, the first and second rod legs 22 and 23 are removably mounted relative to the first and second legs 13 and 14 permitting use of the first and second rods 21 and 21*a* in a selective manner.

Figure 5:
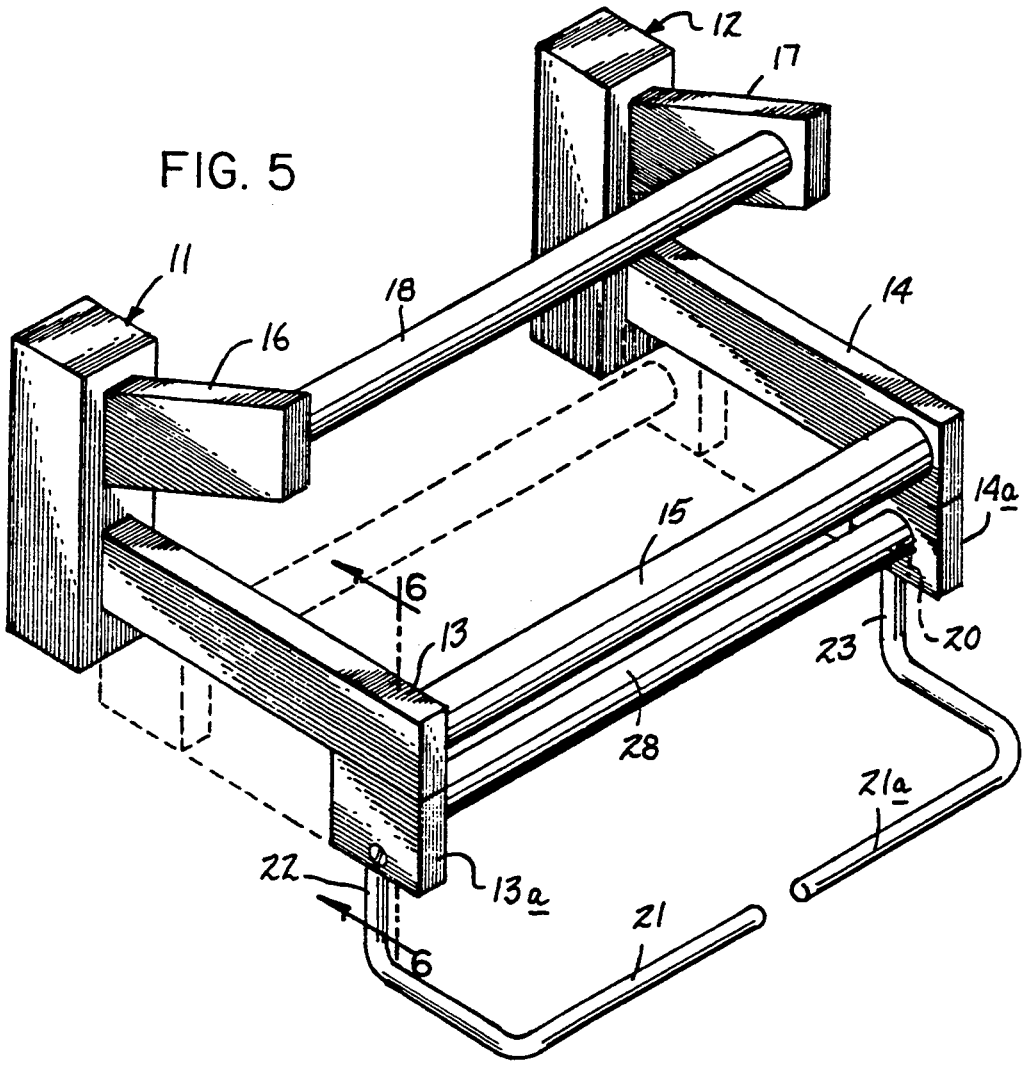
FIG. 5 is an isometric illustration of a further modified aspect of 1he invention.
Figure 6:
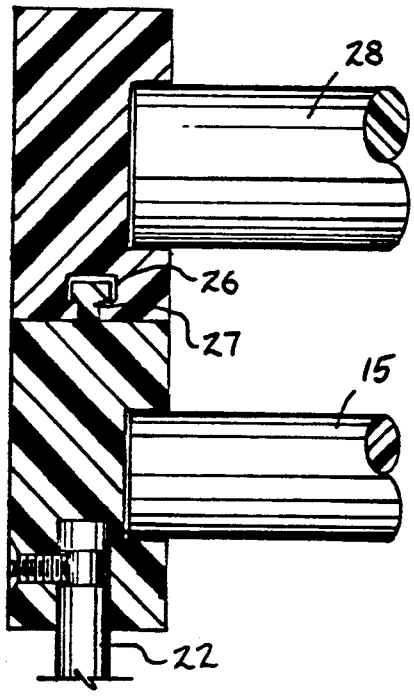
FIG. 6 is an orthographic view, taken along the lines 6—6 of FIG. 5 in the direction indicated by the arrows.

The FIG. 5 employs the first and second rod legs received within first and second leg extension legs 13*a* and 14*a* respectively. The first and second leg extension legs 13*a* and 14*a* each are provided with a T-shaped projection 27 (see FIG. 6.) that in turn is slidably received within a T-shaped slot 26 directed through a bottom wall of the first and second legs 13 and 14. In this manner, the first and second rods 21 and 21*a* are slidably mounted relative to the first and second legs for their retraction towards the first and second support posts 11 and 12. Further, a third mounting bar 28 is mounted between the first and second leg extension legs 13*a* and 14*a* to maintain the first and second leg extension legs and their sliding in a unitary relationship, as indicated in phantom, towards the first and second support posts 11 and 12.

Additionally, the structure of FIG. 7 provides for first and second gear racks 29 and 30 mounted in a parallel spaced relationship for adjustably mounting the support posts 11 and 12 thereon, wherein the first and second support posts each include a gear member 31 rotatably mounted about a gear member axle 32 directed between the first and second support posts to permit rotation of the gear member of each support post and the associated vertical adjustment of the organization relative to the first and second gear racks 29 and 30. To permit the locking of the first and second support posts relative to the first and second gear racks 29 and 30, a locking shaft 33 is reciprocatably mounted within the first support post 11 and orthogonally oriented relative to the periphery of the gear member 31 within the first support posts 11. A V-shaped notch 34 within the locking shaft 33 receives the gear member periphery preventing rotation of the gear member relative to the locking shaft and thereby arresting positioning of the first and second support posts 11 and 12 relative to the gear racks 29 and 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include, variations in size, materials, shape, form, function and manner of operation, assembly and use, are deemed readily apparent and obvious to one skilled in the art, and all equivalent relationships to those illustrated in the drawings and described in the, specification are intended to be encompassed by the present invention, Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A towel rack apparatus, comprising, a first support post spaced from, parallel, and coextensive with a second support post, the first support post having a first leg orthogonally and integrally mounted to the first support post, and the second support post having a second leg integrally and orthogonally mounted to the second support post, wherein the first leg and the second leg are arranged in a parallel coextensive relationship relative to one another, with a first mounting bar extending orthogonally between the first leg and the second leg, and a third leg mounted to the first support post above the first leg, and a fourth leg mounted to the, second support post above the third leg, with the third leg and the fourth leg arranged in a canted projection away from the respective first leg and the second leg, with a second mounting bar orthogonally directed between the third leg and the fourth leg, the first leg having a first leg bottom wall, and the second leg having a second leg bottom wall, wherein the first leg bottom wall includes a first leg T-shaped slot and the second leg bottom wall includes a second leg T-shaped slot, and a first leg extension leg having a first, T-shaped projection received slidably within the first leg T-shaped slot, and a second leg extension leg having a second projection received within the second leg T-shaped slot, and the first leg extension leg and the second leg extension leg including a third mounting bar extending orthogonally between the first leg extension and the second leg extension leg, and the first extension leg having a first bore, and the second leg extension leg having a second bore, with the first bore and the second bore each including a fastener orthogonally intersecting the first bore and the second bore, and a first rod having a first rod leg received within the first bore, wherein the first rod leg includes first rod leg annular recess to receive said fastener within the first bore, and a second rod having a second rod leg received within the second bore, wherein the second rod leg includes a second rod leg annular recess to receive said fastener directed into said second bore.

2. An apparatus as set forth in claim 1 including a first gear rack and a second gear rack, with the first gear rack arranged in adjacency to the first support post, and the second gear rack arranged in adjacency to the second support post, and the first gear rack and the second gear rack arranged in a parallel relationship, and the first support post includes a first support post gear member, and the second support post includes a second support post gear member, and axle member orthogonally directed between the first support post and the second support post rotatably mounting the first support post gear member and the second support post gear member, and a locking shaft reciprocatably mounted relative to the first support post positioned in a parallel relationship relative to the axle, wherein the locking shaft includes a V-shaped notch arranged to receive a periphery of the first support post gear member to arrest rotation of the first support post gear member and permit adjustment of the first support post and the second support post along the first gear rack and the second gear rack.

* * * * *